US011183350B2

(12) United States Patent
Geffroy et al.

(10) Patent No.: US 11,183,350 B2
(45) Date of Patent: Nov. 23, 2021

(54) FERROMAGNETIC PART FOR AN ELECTROMAGNETIC CONTACT, ITS MANUFACTURING PROCESS AND ITS USE

(71) Applicant: Schneider Electric Industries SAS, Rueil Malmaison (FR)

(72) Inventors: Vincent Geffroy, Faramans (FR); Olivier Theron, Montbonnot-Saint-Martin (FR); Julien Henri-Rousseau, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 399 days.

(21) Appl. No.: 16/392,701

(22) Filed: Apr. 24, 2019

(65) Prior Publication Data

US 2019/0378672 A1 Dec. 12, 2019

(30) Foreign Application Priority Data

Jun. 8, 2018 (FR) ..... 18 55023

(51) Int. Cl.
*H01H 49/00* (2006.01)
*C23C 18/32* (2006.01)
(Continued)

(52) U.S. Cl.
CPC ..... *H01H 49/00* (2013.01); *C23C 18/32* (2013.01); *H01H 50/44* (2013.01); *H01H 50/54* (2013.01); *H01H 50/641* (2013.01)

(58) Field of Classification Search
CPC ..... H01H 49/00; H01H 50/44; H01H 50/54; H01H 50/641; H01H 50/163; C23C 18/32;
(Continued)

(56) References Cited

U.S. PATENT DOCUMENTS 4,502,031 A 2/1985 Ito et al.
2016/0086754 A1 3/2016 Shimoda
(Continued)

FOREIGN PATENT DOCUMENTS

CH 415 846 6/1966
DE 75 20 386 11/1975
(Continued)

OTHER PUBLICATIONS ip.com results.*
(Continued)

*Primary Examiner* — Mohamad A Musleh
(74) *Attorney, Agent, or Firm* — Oblon, McClelland, Maier & Neustadt, L.L.P.

(57) ABSTRACT

A new method for manufacturing a ferromagnetic part for an electromagnetic contactor, the ferromagnetic part having both particularly high impact mechanical durability, good ferromagnetic properties and good corrosion resistance, while integrating a non-magnetic gap. The method includes the following successive steps: a step a) of supplying a soft ferromagnetic metal blank part; and a step b) of electroless nickel plating at least one section of the blank part in order to obtain the ferromagnetic part, the section of which is surface coated with a nickel surface layer, with the obtained ferromagnetic part including the soft ferromagnetic metal, which, for at least one electroless nickel plated section, is disposed under the nickel surface layer.

13 Claims, 5 Drawing Sheets

(51) Int. Cl.
*H01H 50/44* (2006.01)
*H01H 50/54* (2006.01)
*H01H 50/64* (2006.01)

(58) Field of Classification Search
CPC ..... C23C 18/1637; C23C 18/1692; C23C 18/1694; C23C 18/36
See application file for complete search history.

(56) References Cited

U.S. PATENT DOCUMENTS

| | | | |
|---|---|---|---|
| 2017/0040132 | A1 | 2/2017 | Tajbakhsh |
| 2017/0040133 | A1 | 2/2017 | Tajbakhsh |

FOREIGN PATENT DOCUMENTS

| | | |
|---|---|---|
| FR | 1.319.342 | 3/1963 |
| JP | 3099945 | 10/2000 |

OTHER PUBLICATIONS

Global dossier result.*
French Preliminary Search Report dated Jan. 18, 2019 in French Application 18 55023, filed on Jun. 8, 2018 (with English translation of categories of Cited Documents and Written Opinion).
Anonymous, "Electroless nickel plating—Wikipedia, the free encyclopedia", XP055137632, 2014, URL:http://en.wikipedia.org/wiki/Electroless_nickel_plating, 5 pages.

* cited by examiner

FERROMAGNETIC PART FOR AN ELECTROMAGNETIC CONTACT, ITS MANUFACTURING PROCESS AND ITS USE

The present invention relates to a method for manufacturing a ferromagnetic part for an electromagnetic contactor, a method for manufacturing an electromagnetic contactor, a ferromagnetic part, an electromagnetic contactor, and a use of a ferromagnetic part.

The present invention relates to the field of electrotechnical devices, in particular for low voltage, and to the ferromagnetic elements intended to equip such devices.

FR 2746541 A1 discloses an example of a known electromagnetic contactor device comprising an electro-magnet provided with a coil with power supply terminals, with a fixed part forming a fixed section of the magnetic circuit and a movable part forming a movable section of the magnetic circuit. The movable part is mechanically connected to a contact holder of the device. Powering the coil causes the contact holder to move by moving the movable part relative to the fixed part under the effect of the electromagnetic field that is thus generated. This movement involves converging and separating the movable part relative to the fixed part.

For some applications, it is known, in order to improve the electromagnetic performance of the movable part and of the fixed part, for a non-zero non-magnetic gap to be maintained between the fixed part and the movable part when these parts are in their closest position. This particularly allows the dropout time of the contactor to be improved, i.e. the time taken for the movable part to return to its position remote from the fixed part, when the coil is no longer powered. The dropout time is an important parameter since it corresponds to the time that will be taken by the contactor to open or close the power circuit once it has received the command.

To this end, it is known for a thin non-magnetic shim to be introduced between the fixed and movable parts in order to limit their convergence. However, it is difficult to design a shim that is both thin enough for the non-magnetic gap to be optimal and is thick enough for the shim to be mechanically durable.

It is also known for a dry phosphatation type surface treatment to be applied, which allows a thin layer of non-magnetic material to be applied on the surface of the fixed and movable parts. In this case, the convergence of the two parts results in them coming into contact through their surface treatment layer. Each time contact is made, an impact occurs between the two parts. After numerous manoeuvres, the successive impacts experienced by these two parts results in deterioration of their surface treatment layer, as well as in dulling, i.e. deformation or wear. The deterioration and dulling changes the electromagnetic properties over time, particularly since the surface treatment layer diminishes and the parts are deformed. In general, when the contactor is used, the dropout time increases or significantly varies.

In order to overcome the aforementioned disadvantages, an aim of the invention is to provide a new method for manufacturing a ferromagnetic part having both particularly high impact mechanical endurance, good ferromagnetic properties and good corrosion resistance, while integrating a non-magnetic gap.

According to a first aspect, the aim of the invention is a method for manufacturing a ferromagnetic part for an electromagnetic contactor, the method comprising the following successive steps:

- a step a) of supplying a soft ferromagnetic metal blank part; and

- a step b) of electroless nickel plating at least one section of the blank part in order to obtain the ferromagnetic part, the section of which is surface coated with a nickel surface layer, with the obtained ferromagnetic part comprising the soft ferromagnetic metal, which, for said at least one electroless nickel plated section, is disposed under the nickel surface layer.

By virtue of the invention, the nickel surface layer provides the ferromagnetic part with impact resistance. When the ferromagnetic part is used in an electromagnetic contactor, it deteriorates more slowly than the means implemented in the prior art. In particular, the drift of the dropout time of the contactor is significantly lower, and certainly less random. The nickel surface layer is non-magnetic, relative to the soft ferromagnetic metal, so that this layer advantageously can be used as an integrated non-magnetic gap. The residual nickel layer also provides the ferromagnetic part with corrosion resistance, given that the ferromagnetic metal is likely to be sensitive to such corrosion. In a preferred embodiment, in which the ferromagnetic part is magnetically annealed, the electroless nickel plating is compatible with this magnetic annealing, which therefore can be performed after the electroless nickel plating. Consequently, the magnetic properties of the ferromagnetic part can be rendered particularly suitable for application to an electromagnetic contactor.

Further advantageous features of the invention are defined hereafter:

- the step b) comprises immersing the blank part in a bath, the bath comprising an aqueous solution of nickel oxide and a reducing agent, preferably sodium hydrophosphite, the blank part being stirred in the bath during immersion in order to be coated by the nickel surface layer over at least 95% of its surface area, preferably over its entire surface area;
- the method comprises, after the step b), a step c) of magnetically annealing the ferromagnetic part coated during the step b), so that the ferromagnetic part obtained on completion of the step c) comprises:
  - the nickel surface layer on the outer surface;
  - the annealed soft ferromagnetic metal under the nickel surface layer for said at least one section electroless nickel plated during the step b); and
  - a nickel layer diffused in the soft ferromagnetic metal due to the magnetic annealing, the diffused nickel layer connecting the nickel surface layer and the annealed soft ferromagnetic metal;
- the step c) comprises subjecting the ferromagnetic part, coated during the step b), to a temperature between 800° C. and 850° C., for a period of between 3 hours and 5 hours, preferably 4 hours;
- the soft ferromagnetic material is an iron-carbon alloy with a carbon content of less than 0.03% by weight.

A further aim of the invention is a method for manufacturing an electromagnetic contactor, the electromagnetic contactor comprising:

- an electromagnetic actuator, comprising at least one coil, one movable ferromagnetic section and one fixed ferromagnetic section, the movable and fixed ferromagnetic sections being configured to switch between a position remote from one another and a contact position; and
- at least one pair of power contacts, which is activated by the movable ferromagnetic section during the switch between the remote position and the contact position, said at least one pair of power contacts then being switched between a closed configuration and an open configuration, the method for manufacturing the electromagnetic contactor comprising a step involving the integration of at least one ferromagnetic part, obtained using the method for manufacturing a ferromagnetic part as described above, in at least one of the movable and fixed ferromagnetic sections.

A further aim of the invention is a ferromagnetic part for an electromagnetic contactor, the ferromagnetic part preferably being obtained using a method as described above, the ferromagnetic part comprising at least one section that comprises:

a nickel surface layer on the surface that is obtained by a step of electroless nickel plating; and a soft ferromagnetic metal coated with the nickel surface layer.

Preferably, the nickel surface layer is between 3 and 50 μm thick, preferably between 5 and 25 μm thick.

A further aim of the invention is an electromagnetic contactor comprising:

an electromagnetic actuator, comprising at least one coil, a movable ferromagnetic section and a fixed ferromagnetic section, the fixed and movable ferromagnetic sections being configured to switch between a position remote from one another and a contact position, at least one of the movable and fixed ferromagnetic sections comprising a ferromagnetic part as described above; and at least one pair of power contacts, which is activated by the movable ferromagnetic section during the switch between the remote position and the contact position, said at least one pair of power contacts then being switched between a closed configuration and an open configuration.

A further aim of the invention is a use of a ferromagnetic part as described above in an electromagnetic contactor as described above, the ferromagnetic part being used as part of the movable ferromagnetic section or of the fixed ferromagnetic section of the electromagnetic actuator.

The following description relates to embodiments of the invention, which are provided by way of non-limiting examples, with reference to the accompanying drawings, in which.

Figure 1:
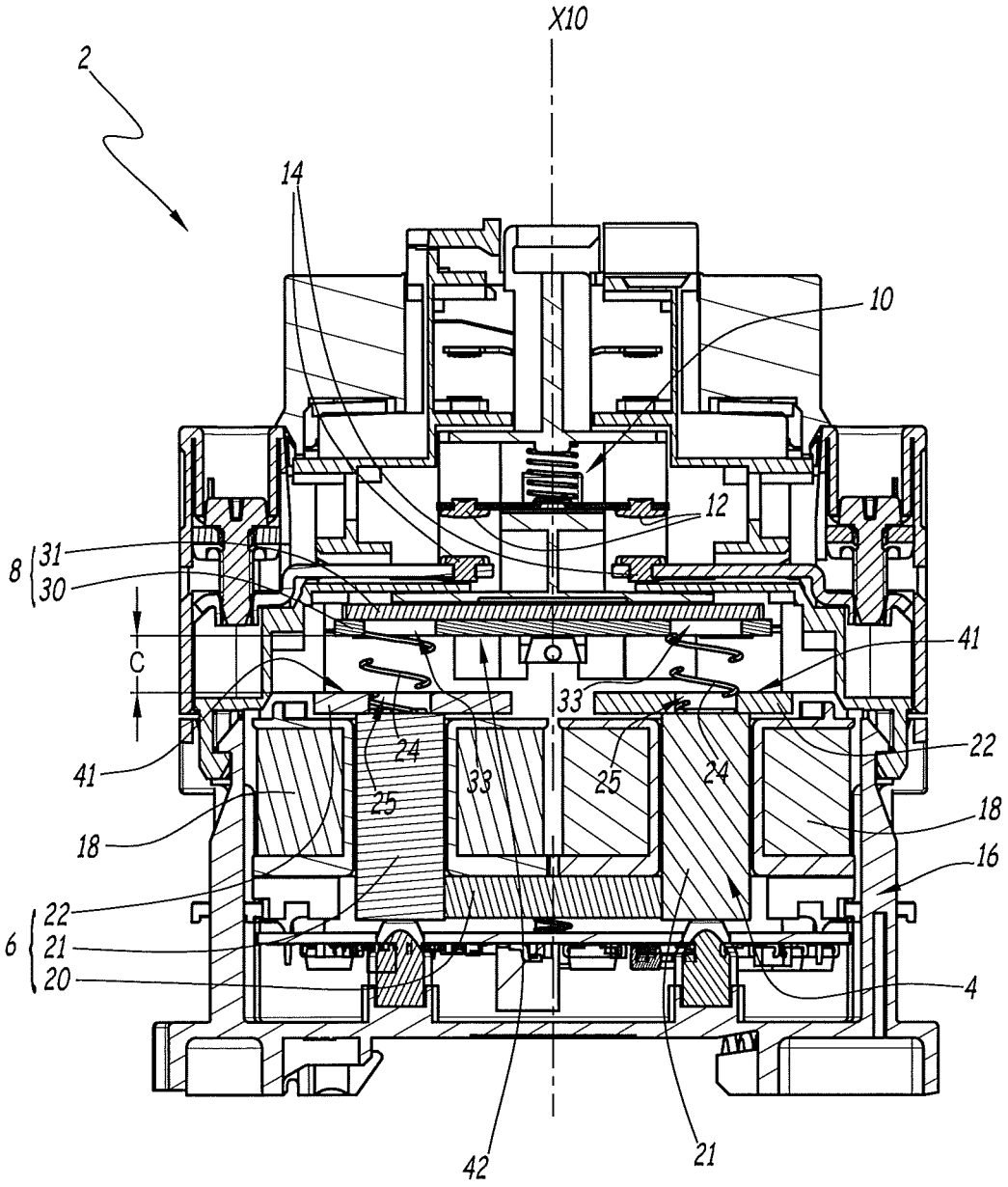
FIGS. 1 and 2 are two section views of the same electromagnetic contactor, in two different configurations, comprising ferromagnetic parts according to the invention.
Figure 2:
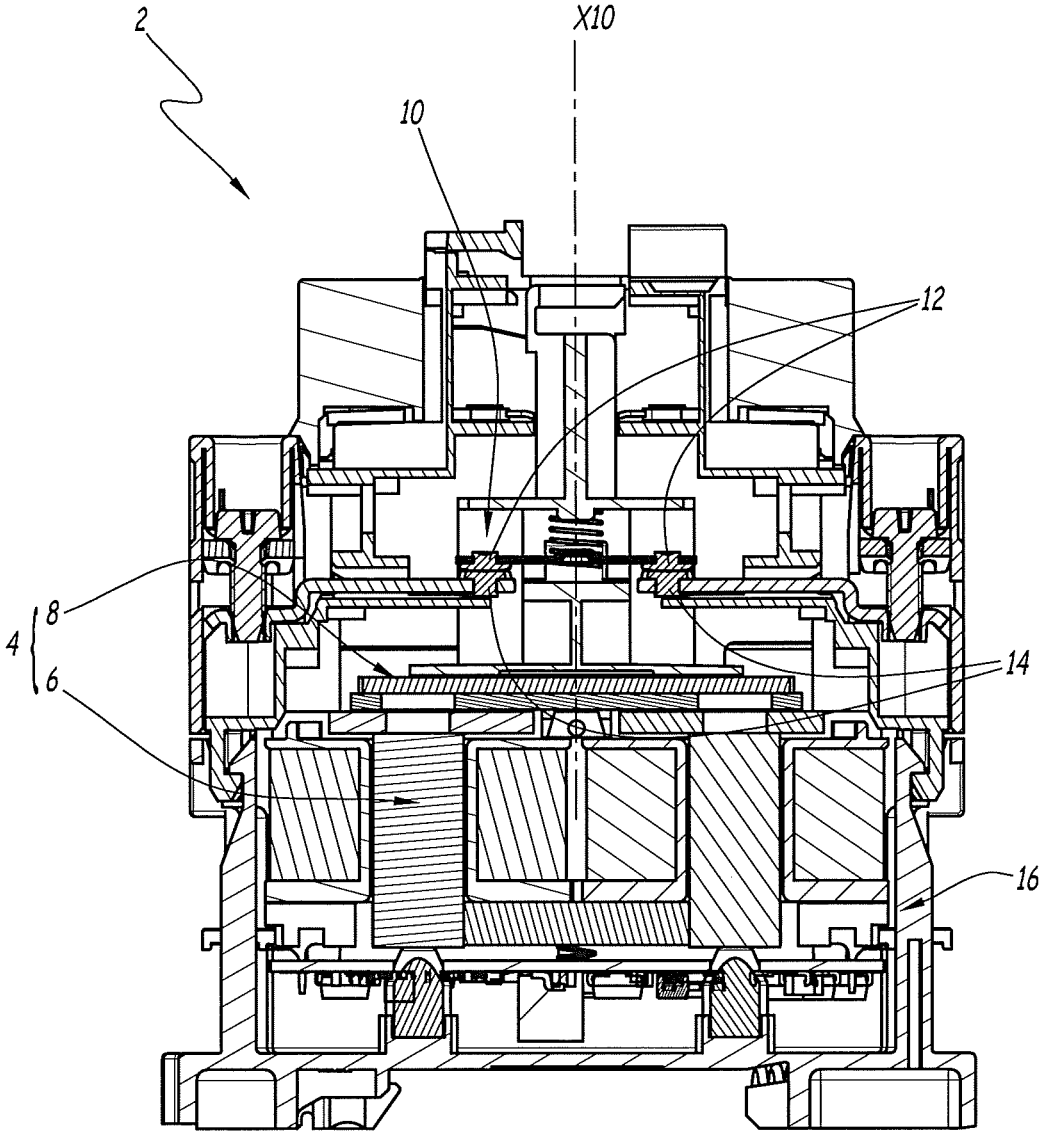

FIGS. 1 and 2 show an electromagnetic contactor 2 that allows the passage of current in a power circuit to be selectively interrupted, for example, between a power supply source and an electrical charge. In FIG. 1, the contactor 2 is shown in an open configuration, in which it blocks the passage of current. In FIG. 2, the contactor 2 is shown in a closed configuration, in which it allows the passage of current.

This contactor 2 is preferably provided for a power circuit called "low-voltage" circuit, i.e. having a voltage that is between 1 V and 600 V, for example, preferably between 100 V and 400 V. For example, it can involve a domestic network, i.e. a network powering a residence, at a single-phase voltage of 110 V or 230 V. Alternatively, this can involve an industrial three-phase 380 V network, for example.

The contactor 2 comprises one or more pairs of power contacts, with each pair comprising a movable contact 12 and a fixed contact 14. The contacts 12 and 14 are power contacts because they are configured to block or to be traversed by the current of the aforementioned power circuit, according to the open or closed configuration of the contactor 2. The number of pairs of contacts 12 and 14 is selected, for example, on the basis of the number of phases of the power circuit, with each pair being associated with a phase. In the present example, two pairs of contacts 12 and 14 are provided, since a single-phase power circuit is involved.

The movable contacts 12 are borne by a contact holder 10, which can move along an axis X10 between:

the "open" position, shown in FIG. 1, in which the movable contacts 12 and the fixed contacts 14 are separated by an electrical isolation distance; and the "closed" position, shown in FIG. 2, in which the movable contacts 12 and the fixed contacts 14 are in contact and connected.

By moving the movable contact 12 jointly with the contact holder 10, each pair of power contacts 12 and 14 therefore moves between a closed configuration, when the contact 12 is in the closed position, and an open configuration, when the contact 12 is in the open position.

The contactor 2 comprises an electromagnetic actuator 4 configured to activate the contact holder 10 between its two open and closed configurations, and therefore, by extension, to simultaneously activate each pair of contacts 12 and 14 between their open and closed positions.

The electromagnetic actuator 4 comprises two coils 18, a fixed ferromagnetic section 6 and a movable ferromagnetic section 8. The section 8 can move along the axis X10 between a position remote from the fixed section 6, shown in FIG. 1, and a position in contact with the fixed section 6, shown in FIG. 2. The translational stroke of the section 8 relative to the section 6 is shown by the distance C in FIG. 1, measured parallel to the axis X10. In the remote position, the sections 6 and 8 are separated by the distance C. In the contact position, the sections 6 and 8 are in contact against each other and are therefore closer to one another.

The contact holder 10, and therefore each contact 12 simultaneously, is moved, preferably translationally along the axis X10, by means of the movable section 8 of the electromagnetic actuator 4. When the section 8 is in the remote position, the pairs of contacts 12 and 14 are in the open configuration. When the section 8 is in the contact position, the pairs of contacts 12 and 14 are in the closed configuration. To this end, provision is made for the position of the contact holder 10 to be associated with that of the section 8. In this case, the contact holder 10 and the movable section 8 of the actuator 4 are translationally associated along the axis X10. In the example, the section 8 of the actuator is assembled on the contact holder 10 in order to rigidly connect it to the contact holder 10.

By way of a variation, provision can be made, conversely, for the remote position of the section 8 to lead to implementation of the closed configuration of the pairs of contacts 12 and 14, and for the contact position of the section 8 to lead to implementation of the open configuration of the pairs of contacts 12 and 14.

The fixed section 6 comprises a ferromagnetic armature with a U-shaped architecture. The armature comprises a base 20 and two cores 21 that extend, from the base 20, parallel to the axis X10. The armature of the fixed section 6 also comprises two separated ferromagnetic parts 22. The parts 22 are respectively mounted at the free ends of the cores 21, opposite the base 20. The two parts 22 are each flat in the same plane orthogonal to the axis X10.

By way of a variation, the fixed section 6 can be formed by a single integral ferromagnetic part, rather than by assembling various ferromagnetic parts 20, 21 and 22 that are mentioned above.

Figure 3:
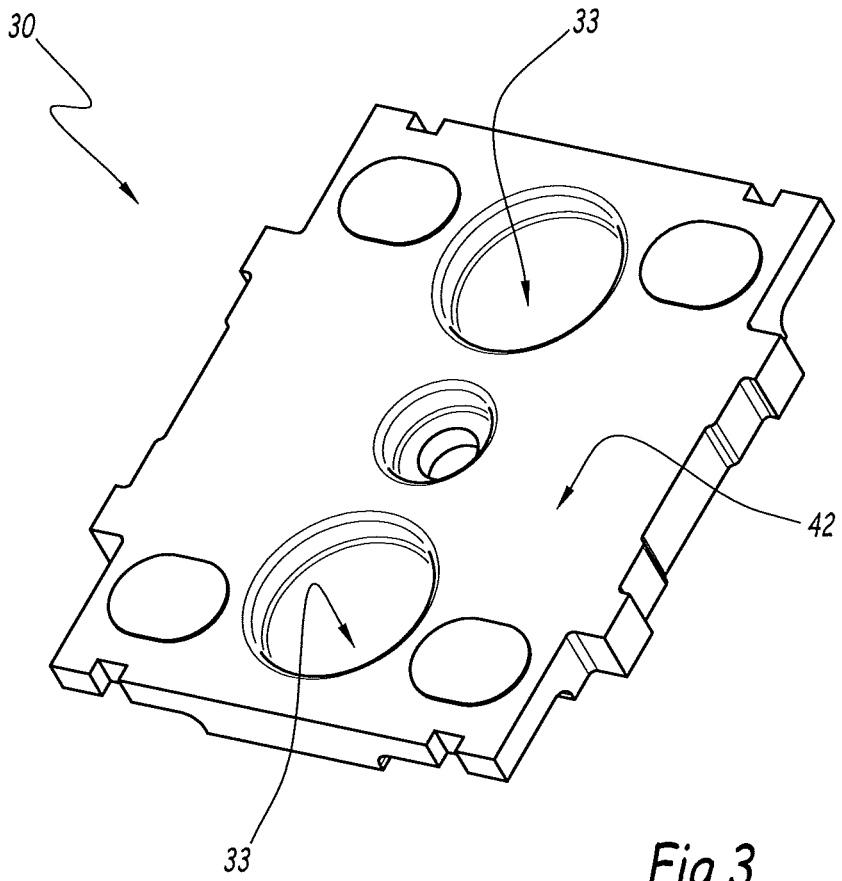
FIG. 3 is a perspective view of one of the ferromagnetic parts of the preceding figures.

The movable section 8 comprises a ferromagnetic part 30, as shown in FIGS. 1 and 2, and shown on its own in FIG. 3. The part 30 preferably is a flat part, which extends in a plane orthogonal to the axis X10. The movable section also comprises a second ferromagnetic part 31, which also forms a flat part in flat abutment against the part 30.

By way of a variation, the movable section 8 forms a single integral ferromagnetic part.

The fixed section 6 and the movable section 8 are called "ferromagnetic", i.e. they are formed of materials, and form structures, that make them susceptible to being magnetised under the effect of the magnetic field generated by the coils 18 in order to form a magnetic circuit, conducting the magnetic flux produced by the coils 18. In the present example, the ferromagnetic parts 20, 21, 22, 30 and 31 form a closed magnetic circuit, in the form of a loop, when the section 8 is in the contact position with the section 6.

Each coil 18 is wound around one of the cores 21. When they are supplied with electrical current, the coils 18 generate a magnetic field that leads to magnetisation of the fixed section 6 and of the movable section 8. The sections 6 and 8 are thus mutually drawn together. When the coils 18 are powered, the section 6 transitions to the contact position with the section 8. When the power supply of the coils 18 is interrupted, the sections 6 and 8 demagnetise, so that the sections 6 and 8 are no longer drawn together. The section 6 thus returns to the position remote from the section 8, under the effect of the return means described hereafter.

The parts 22 are disposed facing the part 30, parallel to the axis X10. The parts 22 extend in the same plane that is parallel to the plane of the part 30, with these planes being orthogonal to the axis X10. Each part 22 comprises a respective contact face 41 and the part 30 comprises a contact face 42. In the remote position, the part 30 is separated from the parts 22, the contact face 42 being separated from the faces 41 by the distance C. In the contact position, the part 30 is in flat abutment against the parts 22, with the face 42 coming into flat abutment against the faces 41.

The electromagnetic actuator 4 comprises means for returning the movable section 8 to the remote position, which means extend, for example, between the fixed section 6 and the movable section 8. In the example shown, these return means are formed by two helical compression springs 24 interposed parallel to the axis X10 between the part 31 and the cores 21. For the sake of the clarity of the drawings, the springs 24 are not shown in FIG. 2.

The springs 24 are held in position in relation to the sections 6 and 8. To this end, each spring 24 is introduced into a respective through-hole 33 of the part 30 and into a respective through-hole 25 of one of the parts 22. Each pair of through-holes 25 and 33 associated with one of the springs 24 is respectively coaxial to an axis parallel to the axis X10. The holes 25 respectively extend from the faces 41 up to the core 21. The holes 33 extend from the face 42 up to the part 31.

The contactor 2 comprises a casing 16 at least partially containing the contacts 12 and 14 and fully containing the actuator 4.

Preferably, as described hereafter, the faces 41 and 42 are made of a non-magnetic material forming a gap integrated in the parts 22 and 30. Thus, the gap material is integral with the parts 22 and 30, respectively. The term "gap" denotes a section of the magnetic circuit in which the induction flux does not circulate in a ferromagnetic material. In other words, the gap is an interruption of the magnetic circuit formed by the sections 6 and 8 that is maintained when the section 8 of the contactor 2 is in the contact position. In the remote position, a gap is therefore formed both by the air separating the faces 41 and 42 and by the layer of non-magnetic material forming the faces 41 and 42.

By way of a variation, provision can be made for a shim to be interposed that is made of non-magnetic material, in addition to the gap already provided by the faces 41 and 42. Henceforth, the faces 41 and 42 are not in mutual contact. In the contact position, the shim of non-magnetic material comes into contact with the faces 41 and 42 by being interposed between them. This allows a thicker gap to be obtained in the contact position. This shim of non-magnetic material is produced, for example, from bronze or a polymer-based plastic material, which are non-magnetic materials, compared to the ferromagnetic material of the sections 6 and 8.

"Dropout time" relates to the duration that elapses between the time when the electrical power supply to the coils 21 of the contactor 2 is stopped and the time when the section 8 reaches the remote position. In other words, the dropout time indicates the speed at which the contactor 2 can change state, i.e., for example, to open and interrupt the current circulating through the power circuit, from the time that the contactor 2 received the order, i.e. from the time when the coils 21 of the actuator 4 are no longer supplied with electrical energy. In general, achieving the lowest possible dropout time is desirable. Without intending to link the dropout time with any particular theory, it would appear that the thinner the gap, obtained in the contact position, the lower the dropout time.

Depending on the application, other shapes can be provided for the fixed and movable ferromagnetic parts of the contactor and for the coils. For example, FR 2746541 A1 discloses a movable magnetic circuit part, called yoke, and a fixed magnetic circuit part, which are each E-shaped, i.e. each having three parallel branches, in particular a central branch. In this document, a single coil is provided around the respective central branch of these two magnetic parts, and surrounds this branch. The movable and fixed ferromagnetic parts, as well as the single coil disclosed in FR 2746541 A1, are suitable for the invention.

Throughout the following description, the term "ferromagnetic part" relates to at least one part of the ferromagnetic sections of the contactors described above, in particular the sections 6 and 8 of the contactor 2. More specifically, the term "ferromagnetic part" can be applied to at least one ferromagnetic part from among the ferromagnetic parts 22 and 30. Preferably, in the contactor 2, at least the ferromagnetic parts 22 and 30 are involved in the following.

Figure 4:
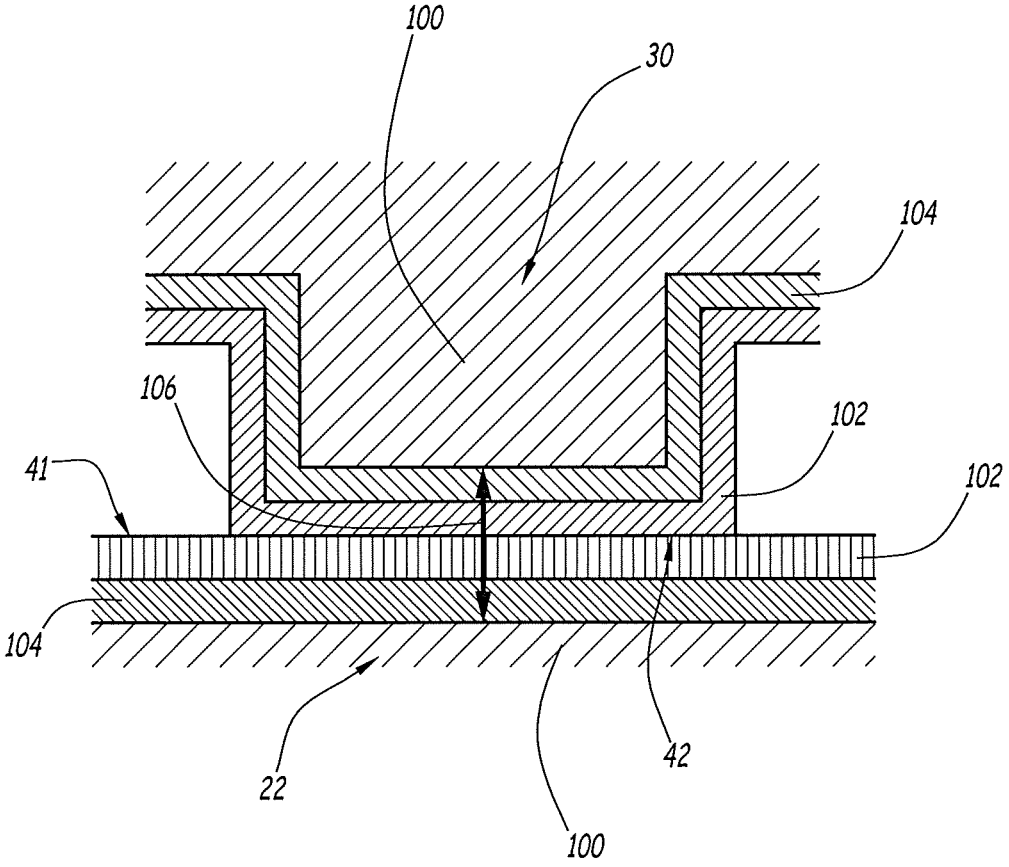
FIG. 4 is a detailed view of FIG. 2, showing two ferromagnetic parts of the contactor, in a schematic manner and to a larger scale.

FIG. 4 schematically shows, to a large-scale and exaggerated in order to facilitate understanding, one of the ferromagnetic parts 22 and the ferromagnetic part 30 in the contact position, i.e. in contact with each other via their respective face 41 and 42.

The ferromagnetic part basically comprises a soft ferromagnetic material, i.e. in particular for most of its volume.

This soft ferromagnetic metal is at least present at the centre of the ferromagnetic part, i.e. in a central internal section of its volume. For example, as shown in FIG. 4, the parts 22 and 30 comprise the soft ferromagnetic metal 100 at the centre. In some embodiments of the invention, the soft ferromagnetic metal is also present on the surface of the ferromagnetic part, for surfaces that are not occupied by the nickel layer described hereafter.

The term "soft" is understood to mean that the selected metal easily magnetises under the effect of a magnetic field and easily loses its magnetisation when it is no longer subject to the magnetic field.

The selected soft ferromagnetic metal is, for example, a soft iron alloy or a low carbon steel. For example, provision is made for the soft ferromagnetic metal to be an iron-carbon alloy having a carbon content, i.e. a mass rate of carbon, that is less than 0.03% by weight. A pure iron can be provided.

The ferromagnetic part can have a layered structure, i.e. can be the result of a laminated stack of layers made of the aforementioned ferromagnetic metal.

Alternatively, the individual structure of the ferromagnetic part can be solid, i.e. without layering. In this case, the ferromagnetic part is formed as a single piece by the soft ferromagnetic metal.

The ferromagnetic part comprises, for the entire surface area of at least one of its faces, a nickel surface layer, obtained by a step of electroless nickel plating. This nickel surface layer is present as a skin of the ferromagnetic part on the one or more relevant faces. The nickel surface layer coats the soft ferromagnetic metal for this or these face(s). At this point, the soft ferromagnetic metal is therefore located under the nickel surface layer.

With respect to the parts 22 and 30 shown in FIG. 4, the contact faces 41 and 42 comprise a nickel surface layer 102 as described above.

To ensure that the ferromagnetic part comprises a nickel surface layer as a skin and a soft ferromagnetic metal at the centre, a blank part made of the desired soft ferromagnetic metal is initially provided, with the desired structure, for example, layered or solid, and with the desired geometry, for example, as described above for parts 22 and 30. Subsequently, at least one section of the blank part undergoes electroless nickel plating in order to obtain the desired ferromagnetic part. On completion of the electroless nickel plating, the surface of the electroless nickel plated section is coated with a nickel surface layer.

Any suitable electroless nickel plating method can be used, preferably, subject to the use of medium or high phosphorus electroless nickel, i.e. more than 5% of phosphorus by weight.

Preferably, in order to perform electroless nickel plating, the blank part is immersed in a bath. Preferably, the bath comprises an aqueous solution of nickel oxide and a reducing agent, preferably sodium hydrophosphite. A nickel oxide reduction reaction occurs of itself, under the action of the reducing agent, so that an electrical current does not need to be used. The blank part is preferably stirred in the bath during immersion, so that all the desired surface is coated, and is evenly coated. For example, this stirring can be performed in a barrel, a chamber or a tank. The thickness of the nickel surface layer is particularly determined by the immersion time in the bath and by the concentration of reagents in the bath.

The nickel layer advantageously forms a non-magnetic layer on the surface of the ferromagnetic part. For the actuator 4, with the nickel layer being provided on the faces 41 and 42, it advantageously acts as a gap for the magnetic circuit formed by the sections 6 and 8.

By way of a variation, the nickel layer can be provided on only one of the two faces 41 and 42, with the other face advantageously being treated using a different method.

By virtue of this gap integrated into the sections 6 and 8, or into at least one of the sections, the distinct spacer shim does not have to be provided, which allows a gap to be obtained with a thickness, measured parallel to the axis X10, that is particularly low and even, perpendicular to the axis X10. Therefore, the contactor 2 is particularly effective and has a dropout time that is particularly low and stable over time. The contactor 2 is more durable. This does not exclude the possibility of nevertheless providing a separate gap part, as explained above, without departing from the scope of the invention.

On completion of the electroless nickel plating step, the nickel surface layer directly coats the soft ferromagnetic metal without an intermediate layer. The ferromagnetic part can be used in this form.

Since the nickel surface layer is provided on at least one of the faces 41 and 42, it effectively protects the parts 22 and/or 30 from any impact likely to occur each time these ferromagnetic parts come into contact with each other, during the transition of the actuator 4 of the contactor 2 to the contact position. Indeed, the hardness of the nickel surface layer is high compared to the soft ferromagnetic metal, for example, between 400 and 500 HV (Vickers hardness measurement). Consequently, more generally, provision is advantageously made for the surface nickel layer to coat at least one surface of a ferromagnetic part of the contactor, which surface comes into contact with another ferromagnetic part when the actuator is switched from the remote position to the contact position.

With respect to the outer surfaces of the parts 22 and 30, which are not coated by the nickel surface layer, the soft ferromagnetic material is preferably bare.

Provision can be made for a single face to be nickel coated, as explained above. However, preferably, provision is made for at least 95% of the surface area of the outer surface of the ferromagnetic part to be coated by the nickel surface layer. Even more preferably, provision can be made for the entire outer surface of the ferromagnetic part to be coated, i.e. the entire surface area of the relevant part. In this case, the ferromagnetic metal is only present at the centre of the ferromagnetic part, by being fully covered, on the skin, by the nickel surface layer. Thus, the ferromagnetic metal of the centre is fully protected from impacts and from corrosion.

In order to use the ferromagnetic part inside the contactor 2, the nickel surface layer advantageously is external, i.e. it extends from the surface of the relevant part 22 or 30.

The step of electroless nickel plating is preferably performed until the nickel surface layer reaches a thickness that is between 3 and 50 μm, preferably between 5 and 25 μm.

Therefore, the gap that is obtained is thinner than that which would be obtained using a non-magnetic shim, the thickness of which cannot easily be below 100 μm. The thickness of the desired gap is adjusted on the basis of the application, particularly on the basis of the type of contactor to be obtained and of the type of power circuit in which it is to be integrated. This adjustment is easy to obtain, since it basically depends on the duration during which the ferromagnetic part is immersed in the electroless nickel plating bath and on the concentration of the reagents in this bath. Since the gap is so thin, the electrical energy for maintaining the movable and fixed ferromagnetic sections in the contact position is particularly low, including when the contactor is used in a harsh environment, i.e. including when the contactor is subject to impacts and to vibrations.

The ferromagnetic part comprising the nickel surface layer preferably has undergone a step of magnetic annealing, at least with respect to the ferromagnetic metal. "Magnetic annealing" is understood to be heat treatment of the relevant part. This treatment preferably aims to confer the treated part with its magnetic properties that are possibly lost following any deformations that the ferromagnetic metal of the relevant part has experienced in order for the part to be manufactured. The magnetic annealing preferably aims to enlarge the iron grains of the ferromagnetic metal by stabilising the carbides in the grain boundaries, thus promoting the magnetic fluxes in the material. The magnetic annealing comprises, for example, a step in which the ferromagnetic part undergoes a temperature increase, from the ambient temperature, to a temperature Tmax between 800 and 850° C., with a maximum speed of 200° C. per hour. The ferromagnetic part is subsequently maintained at the temperature Tmax between 800 and 850° C., with this first step lasting between 3 and 5 hours. A duration of 4 hours is preferable. In a subsequent step of the magnetic annealing, following the step of maintaining the temperature Tmax, the temperature is reduced slightly to 500° C., before returning to the ambient temperature. The total duration of the magnetic annealing operation comprising the first and the second steps is preferably approximately 20 hours.

In an embodiment that is not shown, the magnetic annealing can be performed before applying the nickel surface layer by electroless nickel plating, in order to subsequently apply the nickel surface layer on the ferromagnetic metal that has undergone the magnetic annealing. In this case, the nickel layer advantageously coats the annealed ferromagnetic metal without an intermediate layer, particularly with the aforementioned ranges of thicknesses.

In another preferable embodiment described hereafter, an example of which is shown in FIG. 4, a diffused nickel layer is intermediately provided between the nickel surface layer and the soft ferromagnetic metal at the centre. To this end, the magnetic annealing is implemented while the relevant ferromagnetic part is already coated with the nickel surface layer. Indeed, the presence of the nickel on the surface is not incompatible with the magnetic annealing. In this case, the nickel layer diffuses towards the centre, i.e. it creates a new layer, called "diffused nickel layer", between the nickel surface layer and the soft ferromagnetic metal, with this diffused nickel layer comprising a mixture of nickel and of the soft ferromagnetic metal, with the nickel of the nickel surface layer propagating towards the centre. In the case of an iron-carbon alloy or of a pure iron, the diffused nickel layer therefore is of the NiFe type. The diffused nickel layer extends from the surface nickel layer towards the centre of the ferromagnetic part.

In FIG. 4, the ferromagnetic parts 22 and 30 thus each comprise a diffused nickel layer 104.

By way of a variation, provision advantageously can be made so that the part 22 does not comprise a diffused nickel layer 104 if it has not undergone the annealing step. Provision even can be made for the part 22 to comprise, instead of the nickel layer 102 applied by electroless nickel plating, an electrolytic nickel layer, or to have undergone another suitable treatment.

After the step of magnetic annealing, the nickel surface layer is very hard, between 750 and 900 HV, for example. The diffused nickel layer exhibits intermediate hardness, for example, of approximately 220 to 260 HV. The soft ferromagnetic metal exhibits generally lower hardness, for example, less than 150 HV. A hardness gradient is therefore obtained, which is able to improve the resistance of the ferromagnetic part and to reduce the rate of wear of the nickel surface layer. Indeed, the presence of the diffused nickel layer avoids any wear of the ferromagnetic parts, by improving the strength of the nickel surface layer on the soft ferromagnetic metal centre.

Preferably, the thickness of the diffused nickel layer is between 3 and 40 μm, preferably between 10 and 30 μm. The diffused nickel layer is formed to the detriment of the thickness of the surface nickel layer, which, whereas it was initially between 5 and 25 μm, is now reduced, for example, to between 3 and 20 μm thick.

In a first test, a soft iron blank part was provided, which underwent electroless nickel plating in order to obtain a 10 μm thick nickel surface layer. This blank part then underwent magnetic annealing, including subjecting the ferromagnetic part to a temperature of 820° C. for a 4 hour cycle. After the magnetic annealing, the thickness of the nickel surface layer was approximately 6.6 μm and the thickness of the diffused nickel layer was 10.3 μm. In a second test, a soft iron blank part was provided, which underwent electroless nickel plating in order to obtain a 25 μm thick nickel surface layer. This blank part then underwent magnetic annealing, including subjecting the ferromagnetic part to a temperature of 820° C. for a 4 hour cycle. After the annealing, the thickness of the nickel surface layer was approximately 14.8 μm and the thickness of the diffused nickel layer was 23.9 μm.

In the event that the layers 102 and 104 are provided, when the parts 30 and 32 are in the contact position, as shown in FIG. 4, a gap is obtained, the thickness of which is denoted by the arrow 106. The thickness of the gap then includes the nickel surface layer and the diffused nickel layer.

Any ferromagnetic part manufactured using the steps of the manufacturing method can be integrated, i.e. mounted or assembled, in an electromagnetic contactor such as the contactor 2, in order to form all or part of the movable ferromagnetic section or of the fixed ferromagnetic section.

The following comparative test was performed. An endurance test was performed on two tripolar contactors, one belonging to the prior art, the other being according to the invention. For each of these contactors, approximately two million cycles were performed at regular time intervals. Each cycle involves switching the movable section of the actuator from the remote position to the contact position, then from the contact position to the remote position. Each cycle has a number, from one to two million, shown on the axis of abscissa X of FIG. 5. For approximately thirty cycles from among the two million cycles, the dropout time was measured and is shown on the ordinate Y of FIG. 5. The dropout time is expressed in milliseconds.

The actuator of the contactor of the prior art comprises, for the fixed section and for the movable section, two respective ferromagnetic parts, which come into contact with one another on each transition to the contact position. The movable section is coated with a phosphate layer, applied by dry phosphatation, for its contact face, and the fixed section is coated with an electrolytic nickel layer. Before implementing the aforementioned cycles, the thickness of the phosphate layer applied on each of the parts is approximately 3.5 μm. No gap part is interposed between the two ferromagnetic parts. These ferromagnetic parts have undergone magnetic annealing performed before the dry phosphatation.

Figure 5:
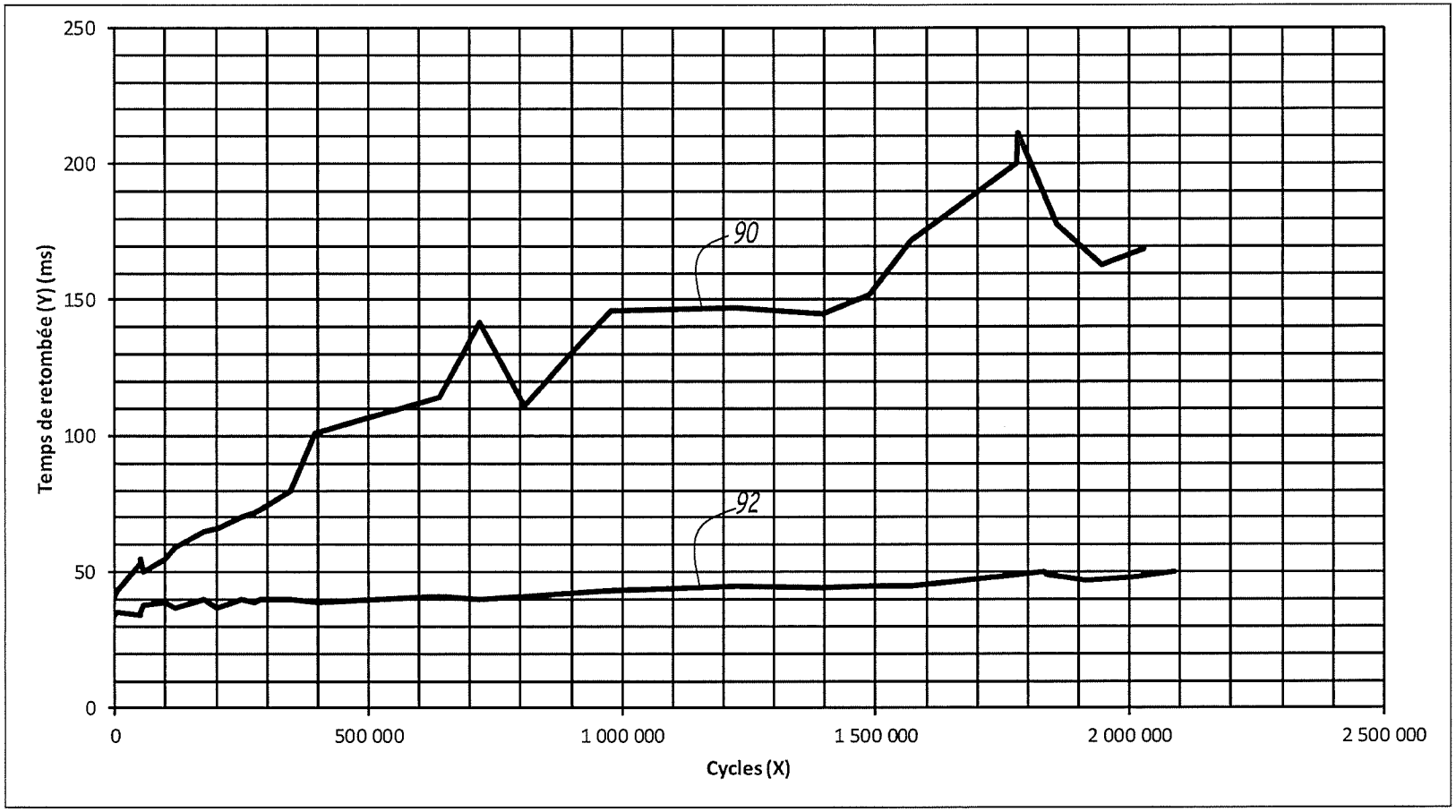
FIG. 5 is a graph showing the results of a comparative test.

The dropout time values for this actuator of the prior art are shown by the curve 90 of FIG. 5.

The contactor according to the invention is identical to the contactor of the prior art, except that the movable section has been coated, on its contact face, with a nickel layer applied by electroless nickel plating, then has undergone magnetic annealing applied after nickel plating. Before implementing the aforementioned cycles, the thickness of the nickel surface layer applied on the movable section is approximately 25 μm and the thickness of the diffused nickel layer is approximately 30 μm.

The dropout time values for this actuator according to the invention are shown by the curve 92 of FIG. 5.

For the first 5000 cycles, it can be seen that the dropout time of the actuator according to the invention, which is between 35 and 40 ms, is below that of the actuator of the prior art, which is between 40 and 50 ms.

At the end of two million cycles, it can be seen that the dropout time of the actuator according to the invention, which is between 45 and 50 ms, is below that of the actuator of the prior art, which is between 160 and 170 ms.

For the contactor of the prior art, the dropout time increases unevenly as and when the cycles are performed. Peaks are observed, particularly at 720,000 cycles, where the dropout time increases to 142 ms, and at 1,779,300 cycles, where the dropout time increases to 211 ms. Troughs are observed following the two aforementioned peaks, at 805, 987 cycles, where the dropout time increases to 111 ms, and at 1,944,121 cycles, where the dropout time increases to 163 ms. It would appear that these uneven variations are caused by the deformation of the ferromagnetic parts under the effect of the impacts, in combination with the detachment of sections of the phosphate layer.

For the contactor according to the invention, the dropout time increases more marginally and more evenly. No significant peaks or troughs are observed for this increase.

The contactor according to the invention has the advantage of providing a very even dropout time, with minimum deviation over time and particularly good repeatability. After two million cycles, the ferromagnetic parts of the contactor according to the invention have a surface finish with acceptable and even wear, whereas the surface finish of the ferromagnetic parts of the contactor of the prior art exhibits significantly more deterioration: the parts have lost some of the phosphate coating, so that the ferromagnetic metal present at the centre is visible on the surface. The ferromagnetic parts of the contactor of the prior art are deformed on the surface, resembling dents, and exhibit significant dull marks, whereas, comparatively, the ferromagnetic parts of the contactor of the invention have better preserved their original geometry.

The invention claimed is:

1. A method for manufacturing a ferromagnetic part for an electromagnetic contactor, the method comprising the following successive steps:

a step a) of supplying a soft ferromagnetic metal blank part; and a step b) of electroless nickel plating at least one section of the blank part in order to obtain the ferromagnetic part, the section of which is surface coated with a nickel surface layer, with the obtained ferromagnetic part comprising the soft ferromagnetic metal, which, for said at least one electroless nickel plated section, is disposed under the nickel surface layer.

2. The method for manufacturing a ferromagnetic part according to claim 1, wherein the step b) comprises immersing the blank part in a bath, the bath comprising an aqueous solution of nickel oxide and a reducing agent, the blank part being stirred in the bath during immersion in order to be coated by the nickel surface layer over at least 95% of its surface area.

3. The method for manufacturing a ferromagnetic part according to claim 1, wherein the method comprises, after the step b), a step c) of magnetically annealing the ferromagnetic part coated during the step b), so that the ferromagnetic part obtained on completion of the step c) comprises:

the nickel surface layer on the outer surface;

the annealed soft ferromagnetic metal under the nickel surface layer for said at least one section electroless nickel plated during the step b); and a nickel layer diffused in the soft ferromagnetic metal due to the magnetic annealing, the diffused nickel layer connecting the nickel surface layer and the annealed soft ferromagnetic metal.

4. The method for manufacturing a ferromagnetic part according to claim 3, wherein the step c) comprises subjecting the ferromagnetic part, coated during the step b), to a temperature between 800° C. and 850° C., for a period of between 3 hours and 5 hours.

5. The method for manufacturing a ferromagnetic part according to claim 1, wherein the soft ferromagnetic material is an iron-carbon alloy with a carbon content of less than 0.03% by weight.

6. The method for manufacturing an electromagnetic contactor, the electromagnetic contactor comprising:

an electromagnetic actuator, comprising at least one coil, a movable ferromagnetic section and a fixed ferromagnetic section, the movable and fixed ferromagnetic sections being configured to switch between a position remote from one another and a contact position; and at least one pair of power contacts, which is activated by the movable ferromagnetic section during the switch between the remote position and the contact position, said at least one pair of power contacts then being switched between a closed configuration and an open configuration;

the method for manufacturing the electromagnetic contactor comprising a step involving the integration of at least one ferromagnetic part, obtained using the method for manufacturing a ferromagnetic part according to claim 1, in at least one of the movable and fixed ferromagnetic sections.

7. A ferromagnetic part for an electromagnetic contactor, the ferromagnetic part being obtained using a method according to claim 1, the ferromagnetic part comprising at least one section that comprises:

a nickel surface layer on the surface that is obtained by a step of electroless nickel plating; and a soft ferromagnetic metal coated with the nickel surface layer.

8. The ferromagnetic part according to claim 7, wherein the nickel surface layer is between 3 and 50 μm thick.

9. An electromagnetic contactor comprising:

an electromagnetic actuator, comprising at least one coil, one movable ferromagnetic section and one fixed ferromagnetic section, the movable and fixed ferromagnetic sections being configured to switch between a position remote from one another and a contact position, at least one of the movable and fixed ferromagnetic sections comprising a ferromagnetic part according to claim 7; and at least one pair of power contacts, which is activated by the movable ferromagnetic section during the switch between the remote position and the contact position, said at least one pair of power contacts then being switched between a closed configuration and an open configuration.

10. A method of using a ferromagnetic part according to claim 7, the ferromagnetic part being used as part of the movable ferromagnetic section or of the fixed ferromagnetic section of the electromagnetic actuator.

11. The method for manufacturing a ferromagnetic part according to claim 2, wherein the reducing agent is sodium hydrophosphite.

12. The method for manufacturing a ferromagnetic part according to claim 2, wherein the blank part is stirred in the bath during immersion in order to be coated by the nickel surface layer over its entire surface area.

13. The ferromagnetic part according to claim 7, wherein the nickel surface layer is between 5 and 25 μm thick.

* * * * *